US006145656A

United States Patent [19]

Marco

[11] Patent Number: 6,145,656

[45] Date of Patent: Nov. 14, 2000

[54] FILM MULTIPACKAGE

[75] Inventor: Leslie S. Marco, Bloomingdale, Ill.

[73] Assignee: Illinois Tool Works Inc., Glenview, Ill.

[21] Appl. No.: 09/373,936

[22] Filed: Aug. 17, 1999

Related U.S. Application Data

[63] Continuation-in-part of application No. 09/220,428, Dec. 24, 1998.

[51] Int. Cl.[7] ..... B65D 75/00

[52] U.S. Cl. ..... 206/147; 206/434; 294/87.2

[58] Field of Search ..... 206/147, 150, 206/151, 155, 427, 434, 192; 294/87.2

[56] References Cited

U.S. PATENT DOCUMENTS

| | | | |
|---|---|---|---|
| 3,118,537 | 1/1964 | Copping | 206/497 |
| 3,200,944 | 8/1965 | Rapata | 206/497 |
| 3,214,016 | 10/1965 | Stephan | 206/497 |
| 3,570,746 | 3/1971 | Wood | 206/434 |
| 4,471,870 | 9/1984 | Uhlig | 206/150 |
| 4,523,676 | 6/1985 | Barrash | 206/150 |
| 4,893,712 | 1/1990 | Allen et al. | 206/139 |
| 4,932,528 | 6/1990 | Benno | 206/432 |
| 5,360,104 | 11/1994 | Sutherland | 206/147 |
| 5,487,463 | 1/1996 | Harris | 206/145 |
| 5,582,289 | 12/1996 | Wright | 206/139 |
| 5,653,334 | 8/1997 | Marco | 206/150 |

*Primary Examiner*—Paul T. Sewell
*Assistant Examiner*—Nhan T. Lam
*Attorney, Agent, or Firm*—Pauley Petersen Kinne & Fejer

[57] ABSTRACT

This invention relates to a single-piece carrier for unitizing a plurality of containers with a retainer sheet integrated with a carrier sleeve. The retainer sheet comprises a plurality of container receiving openings for engaging a top portion of a group of containers of the plurality of containers and two partial container receiving openings for partially engaging a top portion of two additional containers of the plurality of containers. The carrier sleeve surrounds the plurality of containers and a handle is positioned over a center row of containers. A package including containers comprises two layers of containers within the film sleeve.

18 Claims, 11 Drawing Sheets

FILM MULTIPACKAGE

This application is a continuation-in-part patent application of U.S. patent application Ser. No. 09/220,428, filed Dec. 24 1998.

BACKGROUND OF THE INVENTION

1. Field of the Invention

This invention relates to a single-piece carrier for unitizing a plurality of containers, the carrier having a retainer sheet for engaging a top portion of the containers integrated with a film sleeve for surrounding the containers.

2. Description of Prior Art

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, the plastic ring carrier, when used alone, has little or no advertising or promotional printing space. Conversely, the box carrier generally has a relatively large amount of area for promotional graphics. Disadvantageously, the box carrier requires a relatively large amount of material, may permit containers to fall out if it is not maintained in an upright position, and usually shrouds most or all of the actual containers. Therefore, there is a need for a package that incorporates the stability and economy of a ring carrier and the promotional area of a box carrier.

SUMMARY OF THE INVENTION

It is one object of this invention to provide a container carrier that unitizes a plurality of containers into a tight, solid package.

It is another object of this invention to provide a container carrier that provides a prominent billboard space for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is still another object of this invention to provide a container carrier that utilizes a film sleeve to maintain a tight configuration of unitized containers.

A carrier according to this invention carries a plurality of containers such as cans or bottles. The carrier unitizes a plurality of containers to create a package. The carrier is a single-piece device comprising a retainer sheet integrated with a film sleeve, each preferably constructed from a flexible, resilient material such as plastic. The retainer sheet preferably has a first thickness different from and thicker than a second thickness of the film sleeve.

The retainer sheet is formed with a plurality of container receiving openings the number of which depends upon the intended size of the package. The retainer sheet is integrated with the film sleeve preferably along longitudinal sides of the retainer sheet.

The film sleeve may be designed to create a package open at a bottom of the package or along a lower edge of the carrier. The film sleeve may further include a bottom along a portion of the lower edge of the film sleeve. Each side edge of the film sleeve is preferably bound with a seal. The carrier when formed is preferably generally symmetrical around fold lines of the carrier.

Containers are inserted within the carrier so that the containers are surrounded by between five and six sides of the package. Each container receiving opening in the retainer sheet preferably engages a container around an upper portion of the container. The rigidity and elasticity of the retainer sheet thereby supports each container.

The film sleeve is positioned around the plurality of containers, preferably in a stretching engagement with the containers. The film sleeve is preferably printed with graphics, promotional and/or other information related to contents and/or ingredients of package. Therefore, the film sleeve serves both to unitize the plurality of containers and to advertise the nature of the contents of the containers.

The carrier is preferably manufactured according to one of several preferred methods wherein a generally continuous length of carriers is formed. In summary, a film substrate is printed with desired graphics and other merchandising information. A retainer sheet material is next joined to the film substrate by extrusion coating, laminating, profile extrusion or glueing the retainer sheet material to the film substrate. The joined retainer sheet material and film substrate are next either folded along a fold line to create a symmetrical double layer or laminated to an identical section of joined retainer sheet material and film substrate. Seams are next added by heat sealing or laminating the symmetrical double layer of retainer sheet material and film substrate together. Finally, the carrier is formed by die cutting the double layer of retainer sheet material and film substrate to create container receiving openings and to define a film sleeve and a retainer sheet.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
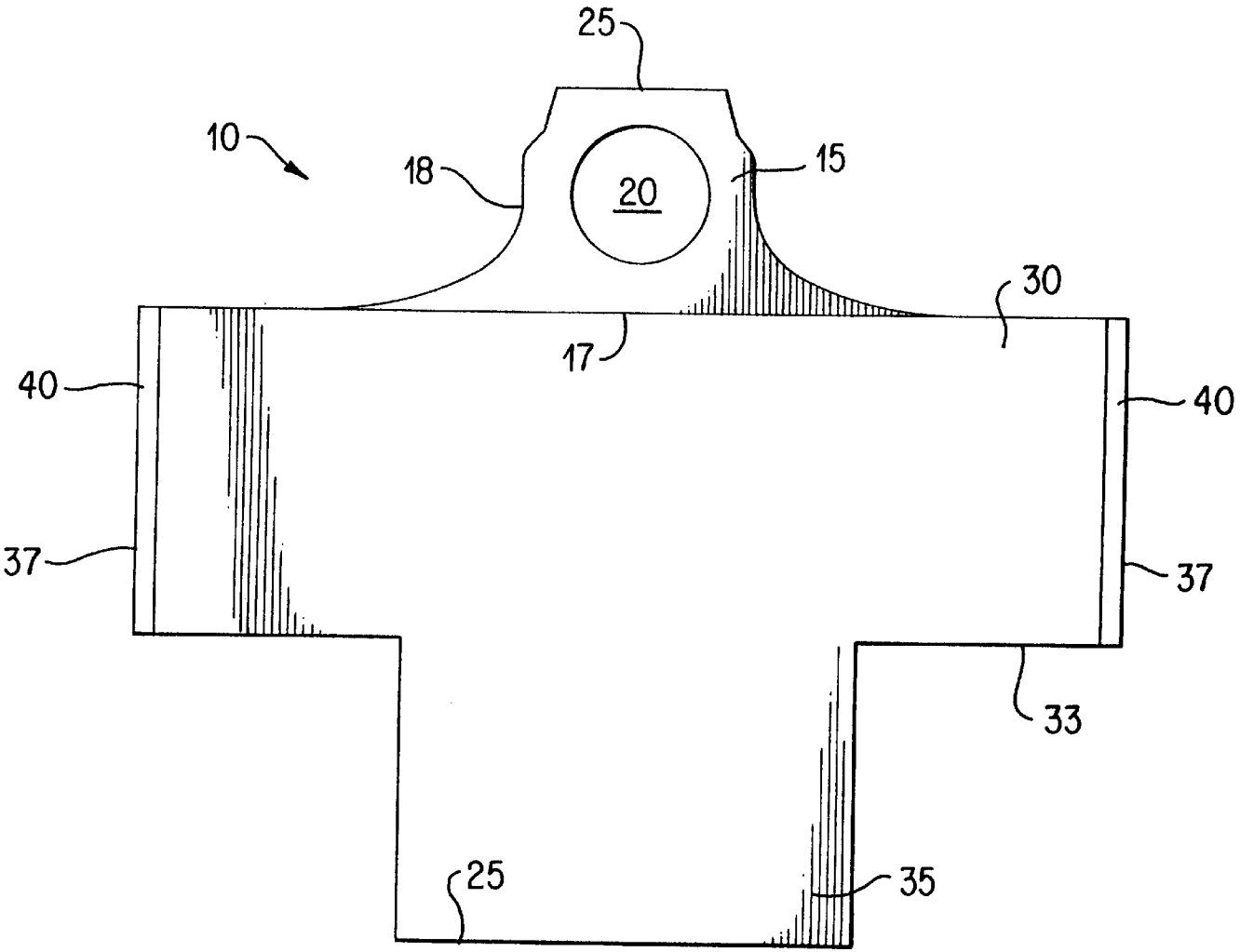
FIG. 1 is a top view of a carrier for holding a plurality of containers according to one preferred embodiment of this invention.
Figure 2:
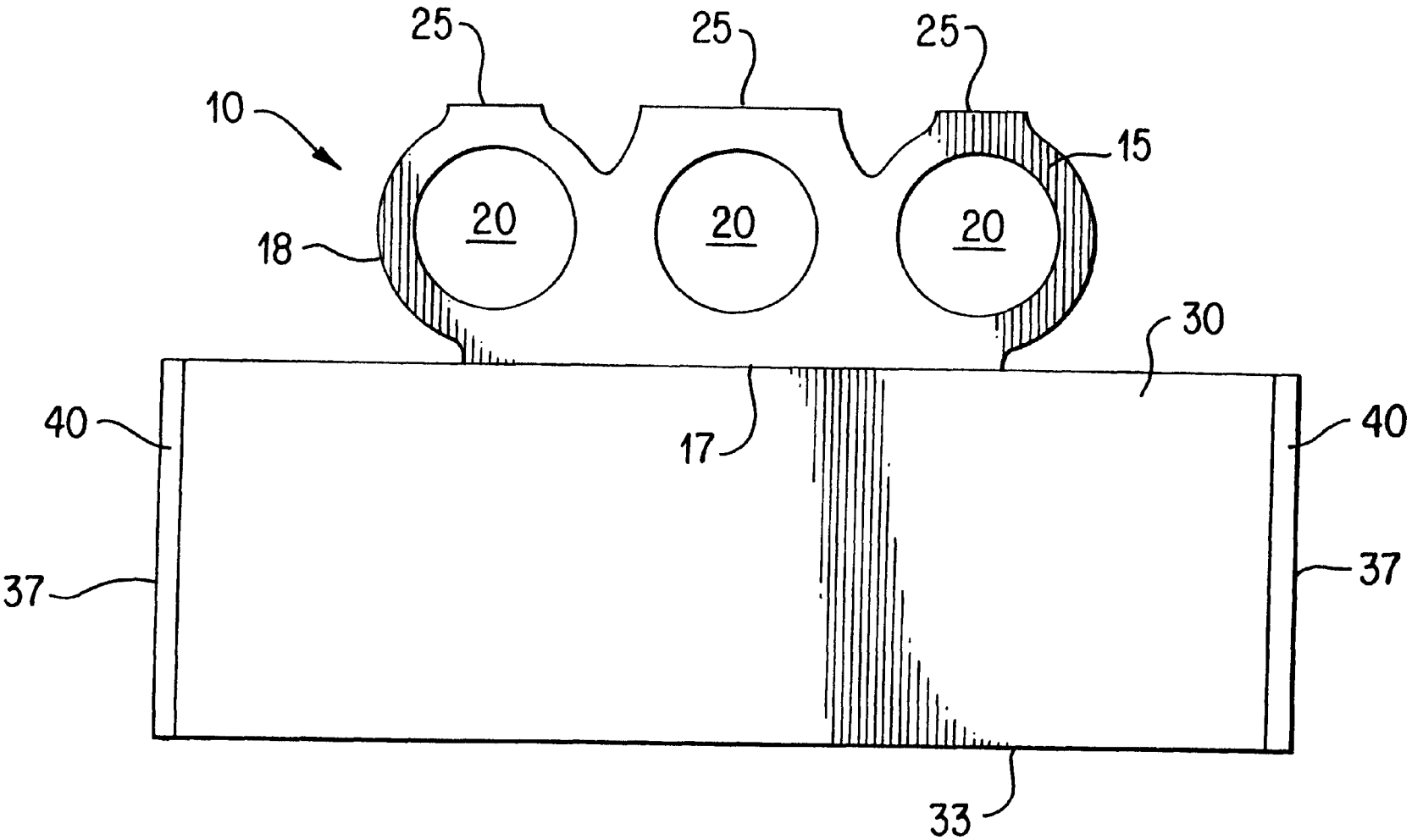
FIG. 2 is a top view of a carrier for holding a plurality of containers according to another preferred embodiment of this invention.
Figure 3:
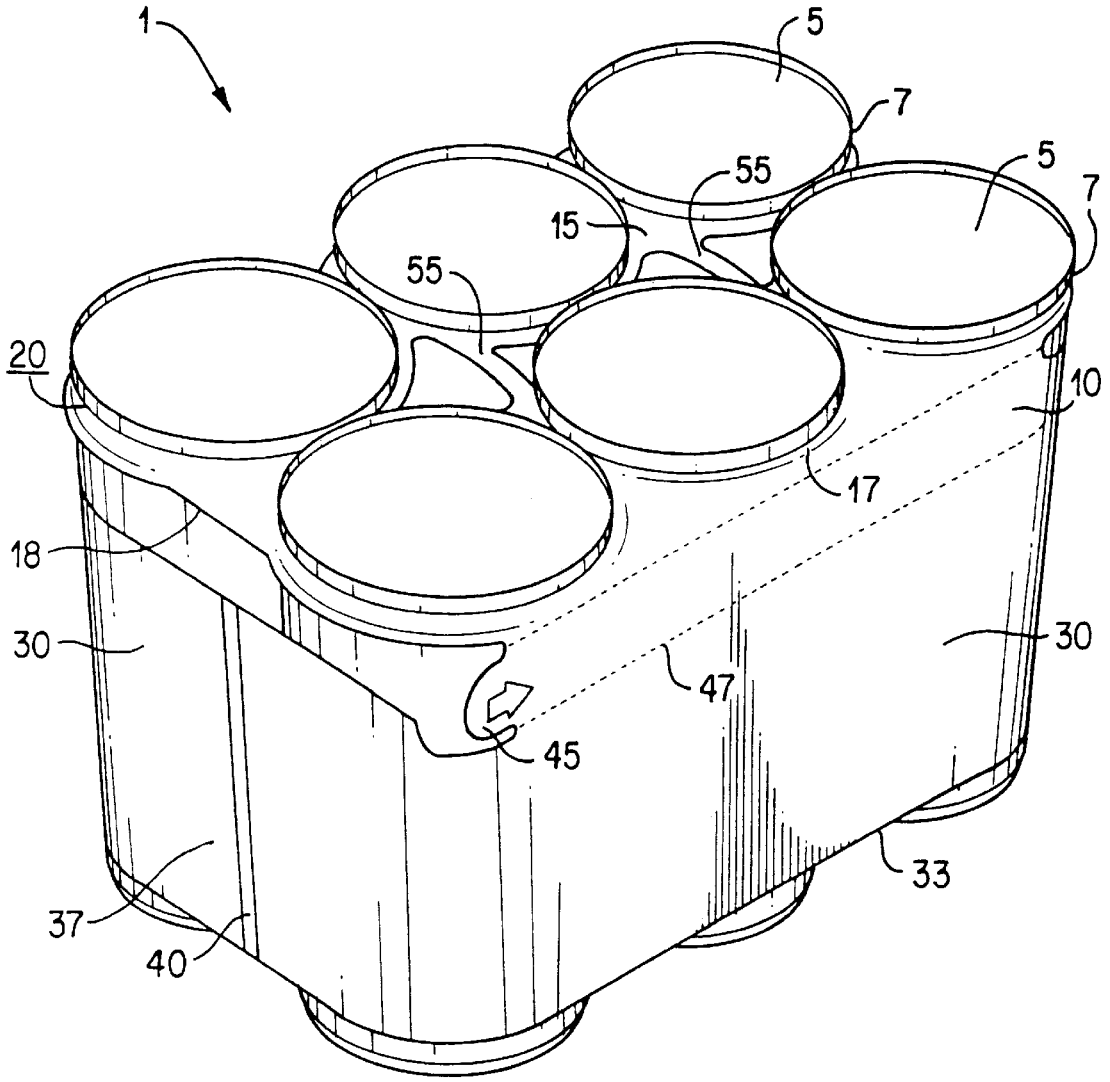
FIG. 3 is a perspective view of a package of containers, using a carrier similar to the carrier shown in FIG. 2, according to one preferred embodiment of this invention.
Figure 4:
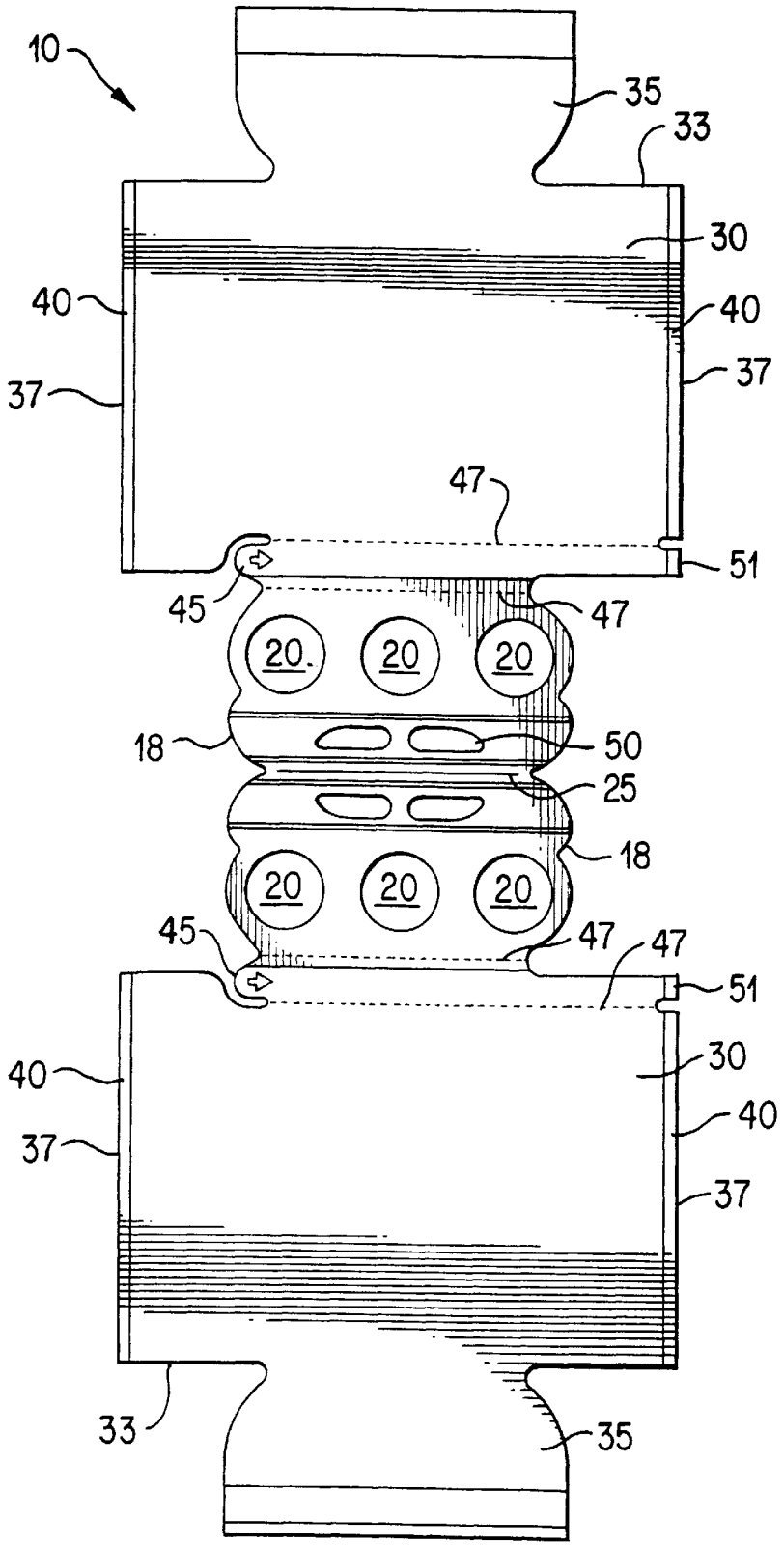
FIG. 4 is a top view of a carrier for holding a plurality of containers according to another preferred embodiment of this invention.
Figure 9:
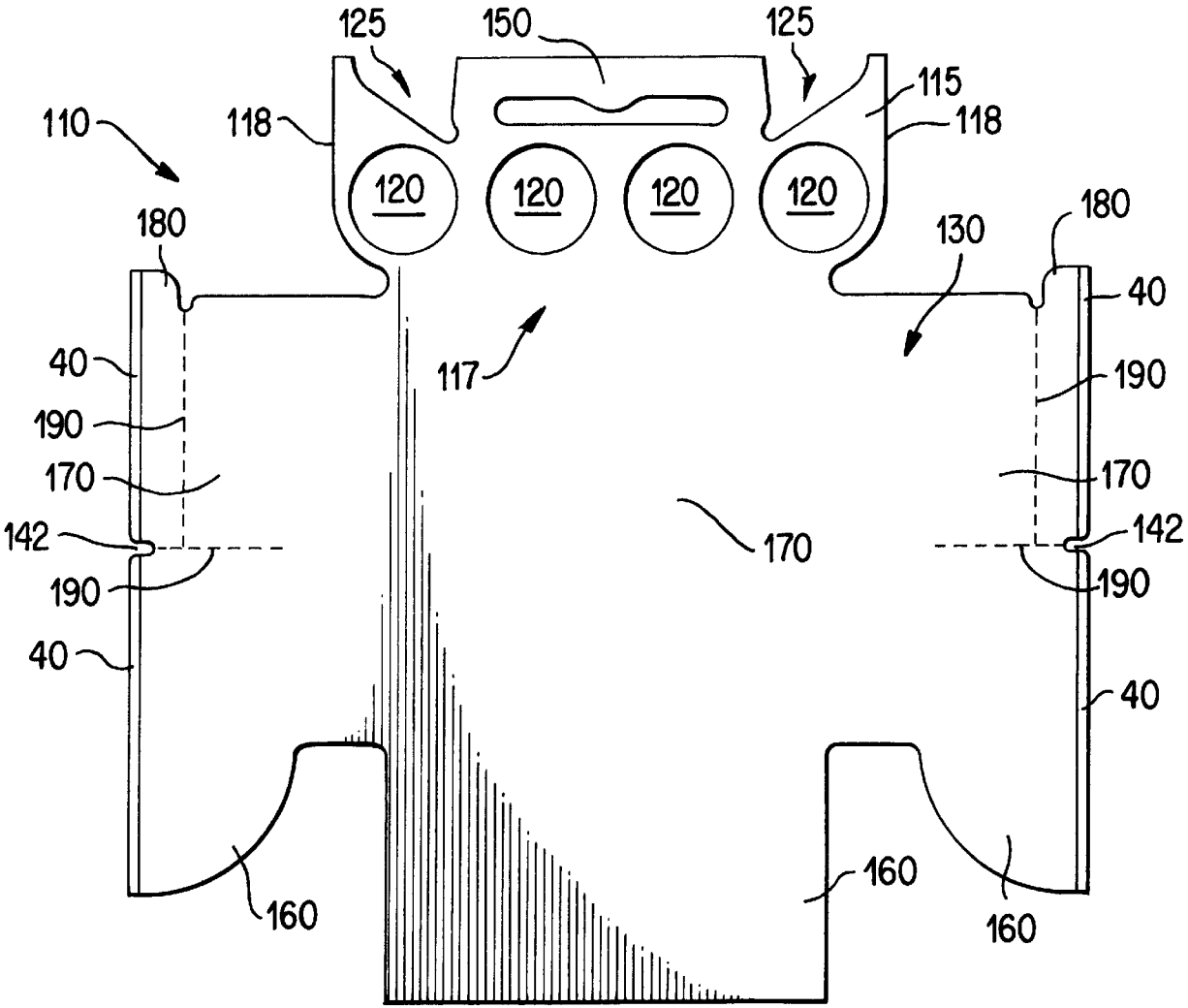
FIG. 9 is a top view of a carrier for holding a plurality of containers according to another preferred embodiment of this invention.
Figure 10:
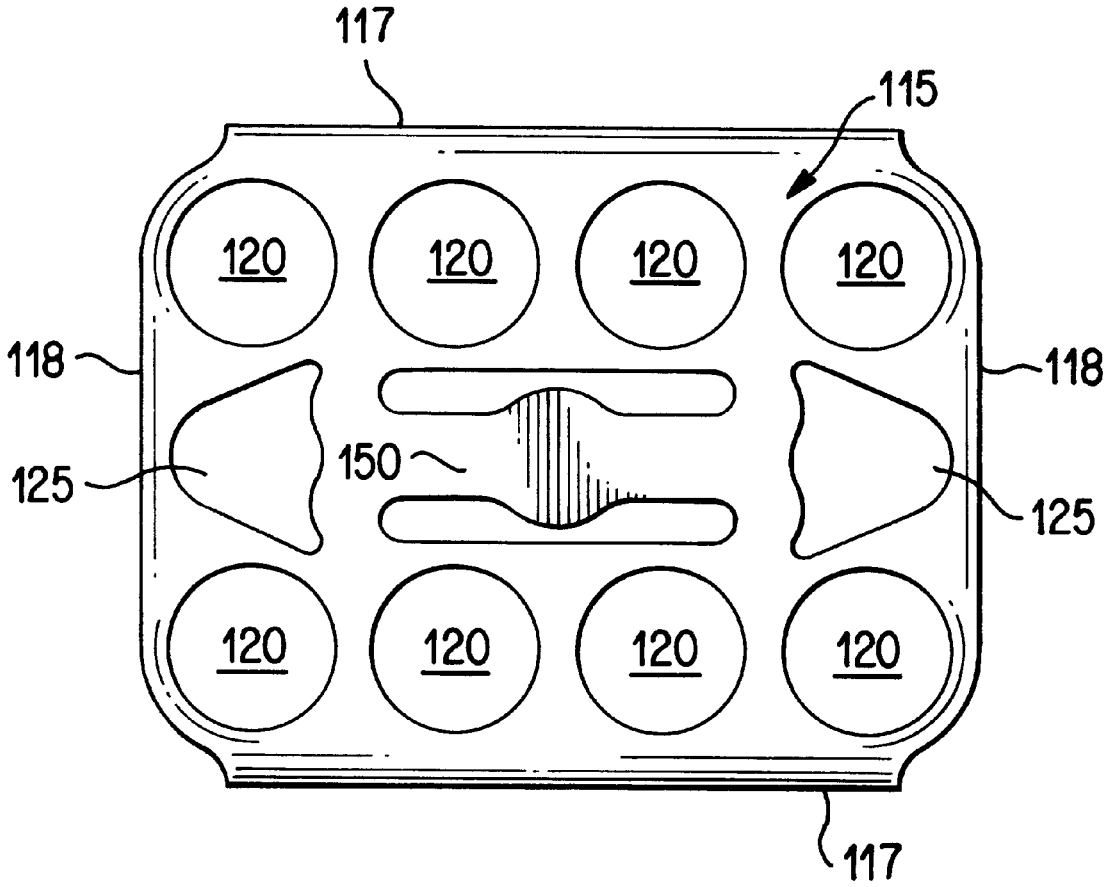
FIG. 10 shows a top view of a retainer sheet as used in the carrier shown in FIG. 9.
Figure 11:
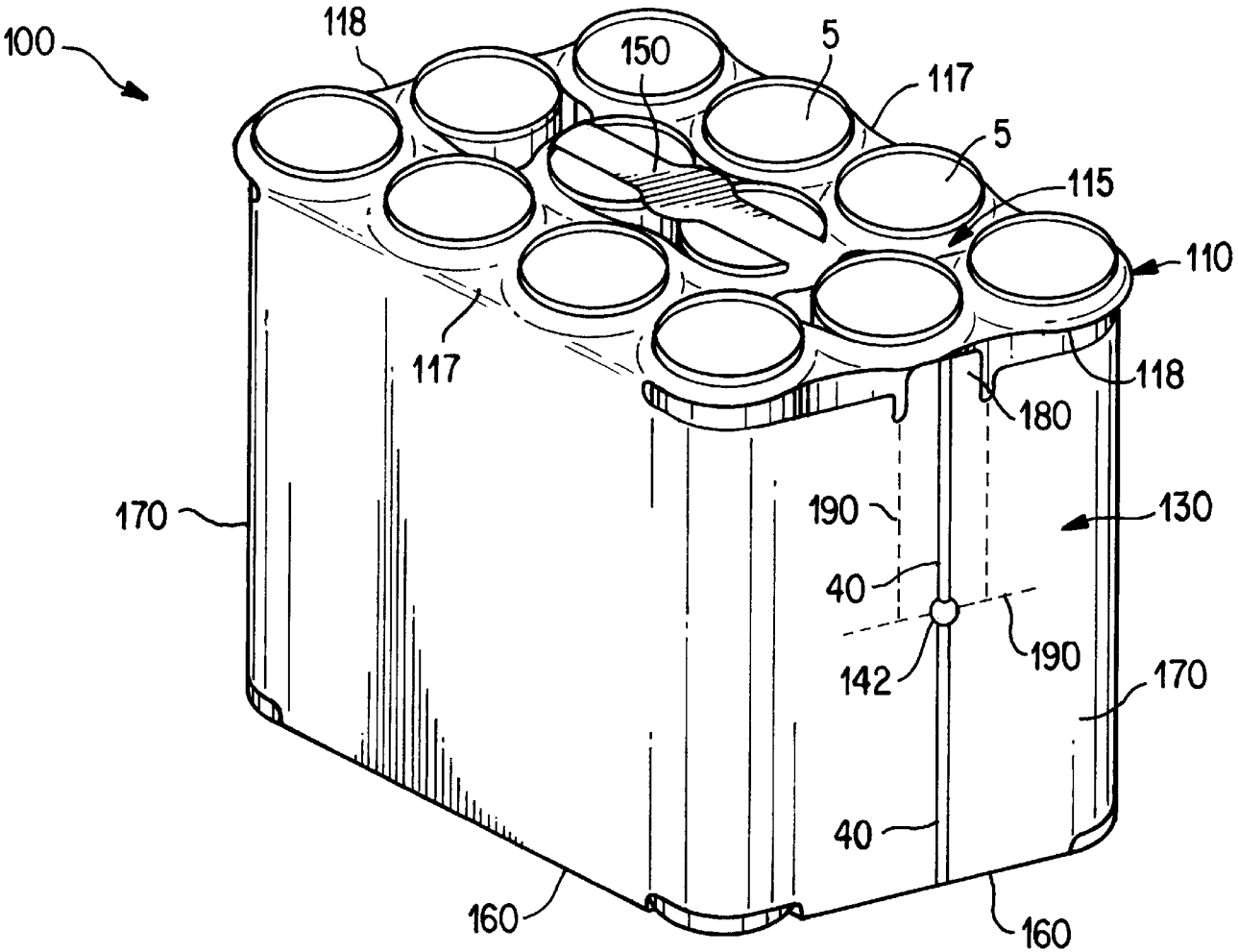
FIG. 11 is a perspective view of a package of containers, using a carrier similar to the carrier shown in FIG. 9, according to one preferred embodiment of this invention.

FIGS. 1-11 show carriers 10 for carrying a plurality of containers 5. Containers 5 as shown in FIGS. 3 and 4 are preferably cans. Although cans are shown in FIGS. 3, 4 and 11, bottles or any other commonly unitized container 5 may be used with carrier 10 according to this invention. Containers 5 are preferably like-sized within a single carrier 10.

Figure 5:
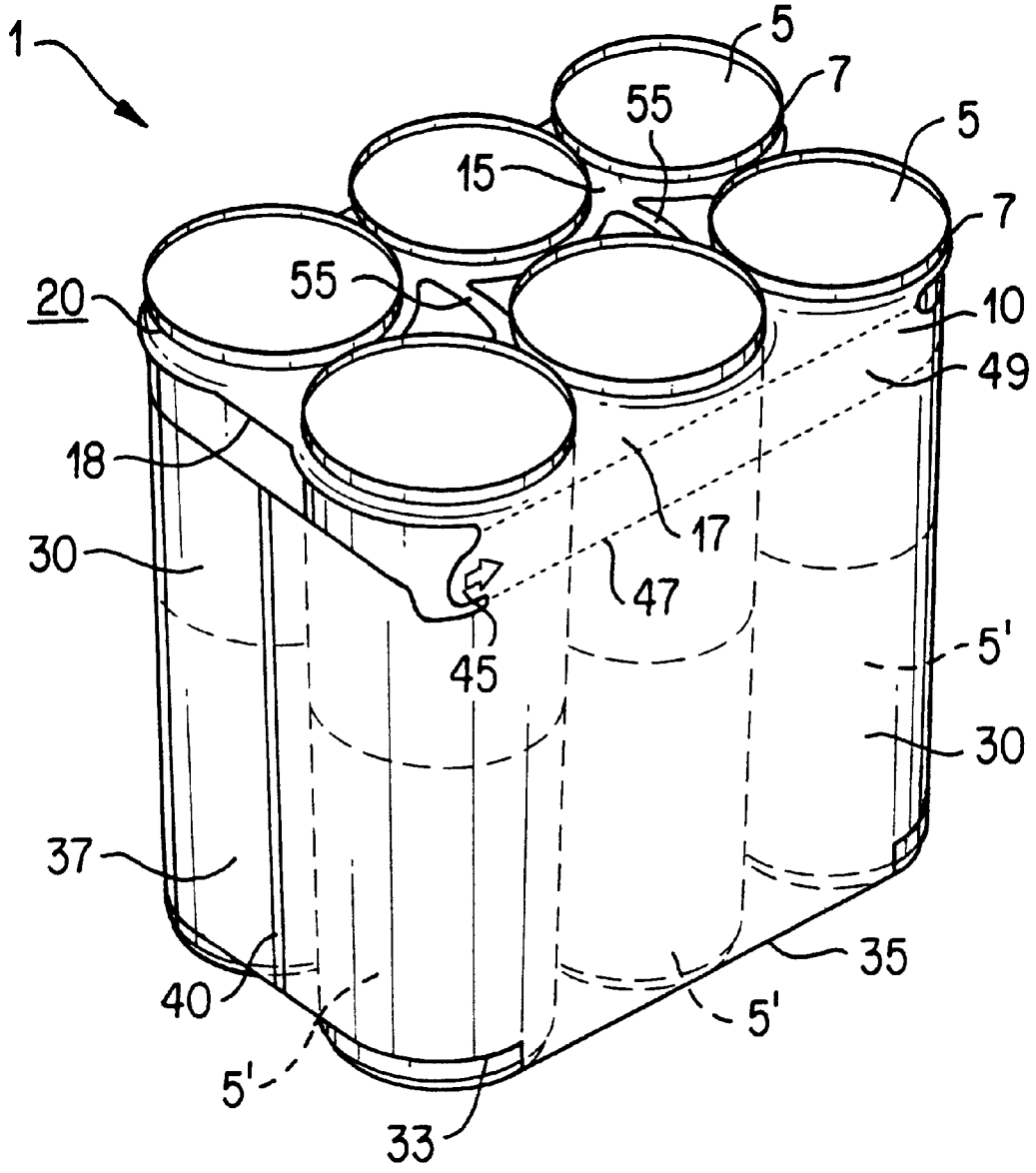
FIG. 5 is a perspective view of a package of containers, using a carrier similar to the carrier shown in FIG. 4, according to one preferred embodiment of this invention.

Carrier 10 unitizes a plurality of containers 5 to create package 1, such as package 1 shown in FIGS. 3, 5 and 11. Carrier 10 is preferably a single-piece device comprising retainer sheet 15 integrated with film sleeve 30, each preferably constructed from a flexible, resilient material such as plastic. For the purposes of this specification and claims, a sleeve is defined as a tubelike component capable of fitting over or around a plurality of containers 5.

In one preferred embodiment of this invention, retainer sheet 15 is made from low density polyethylene. Retainer sheet 15 preferably has a first thickness, such as 0.008", preferably thinner than the thickness of traditional plastic ring carriers. As discussed in additional detail below, retainer sheet 15 is preferably cut, using means known to those skilled in the art such as a stamping die, to form a plurality of container receiving openings 20 in retainer sheet 15. Two or more container receiving openings 20 are formed in retainer sheet 15 in longitudinal rows and one or more transverse ranks. In one preferred embodiment of this invention shown in FIGS. 2–5, container receiving openings 20 are configured in two rows of three ranks. Retainer sheet 15 may include other configurations of container receiving openings 20 depending on the size of package 1 desired.

Retainer sheet 15 is integrated with film sleeve 30 to form a single-piece carrier 10, as described in detail below. Film sleeve 30 preferably has a second thickness that is thinner than the first thickness of retainer sheet 15, such as 0.004" to 0.006". The total thickness of retainer sheet 15 is approximately 0.012–0.014" according to one preferred embodiment of this invention. Film sleeve 30 preferably exhibits greater elasticity and less rigidity than retainer sheet 15. Film sleeve 30 may comprise a stretchable low density polyethylene (LDPE) film or similar material known to those having ordinary skill in the art.

Figure 6:
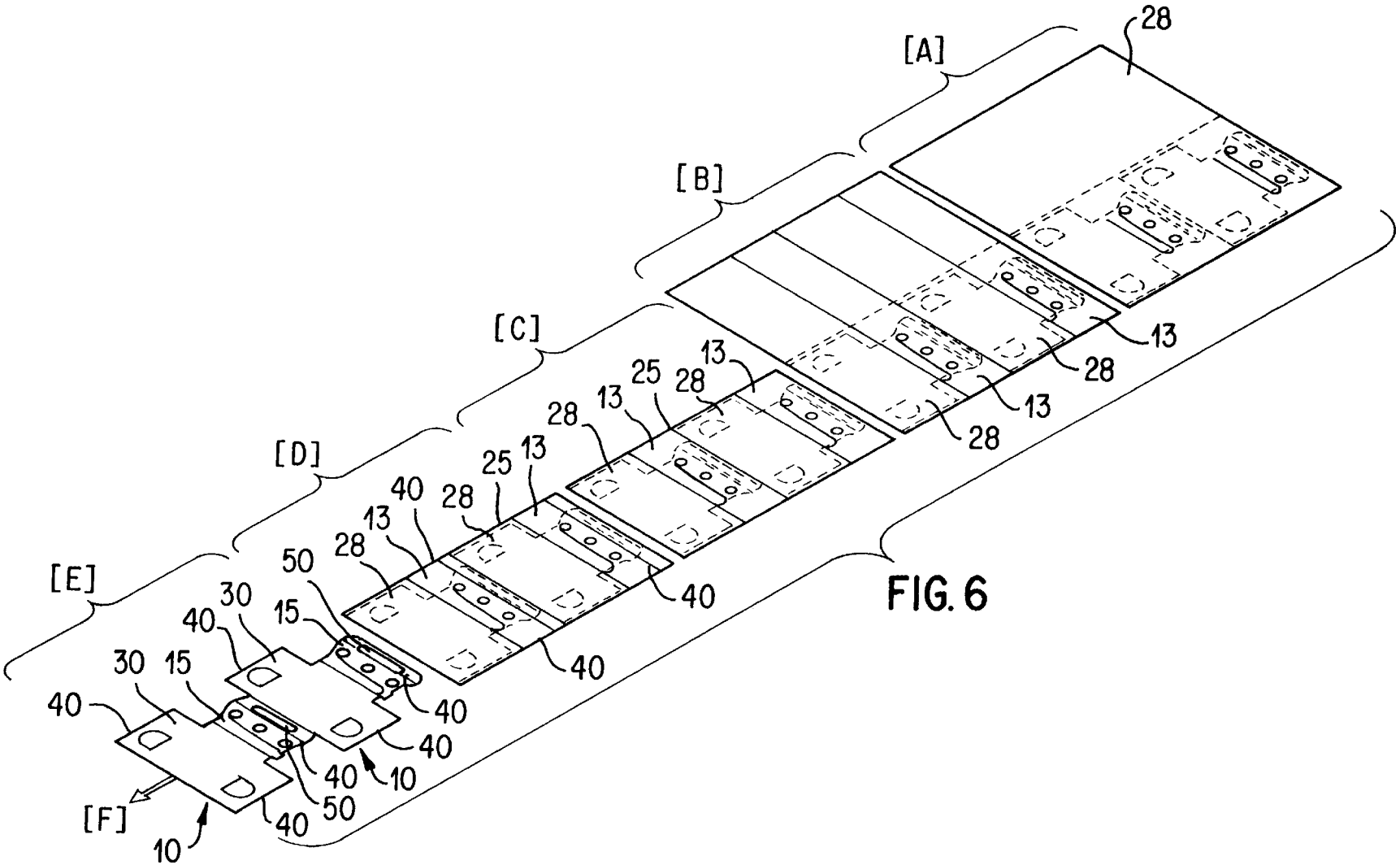
FIG. 6 is a schematic of a method for making a carrier for holding a plurality of containers according to one preferred embodiment of this invention.
Figure 8:
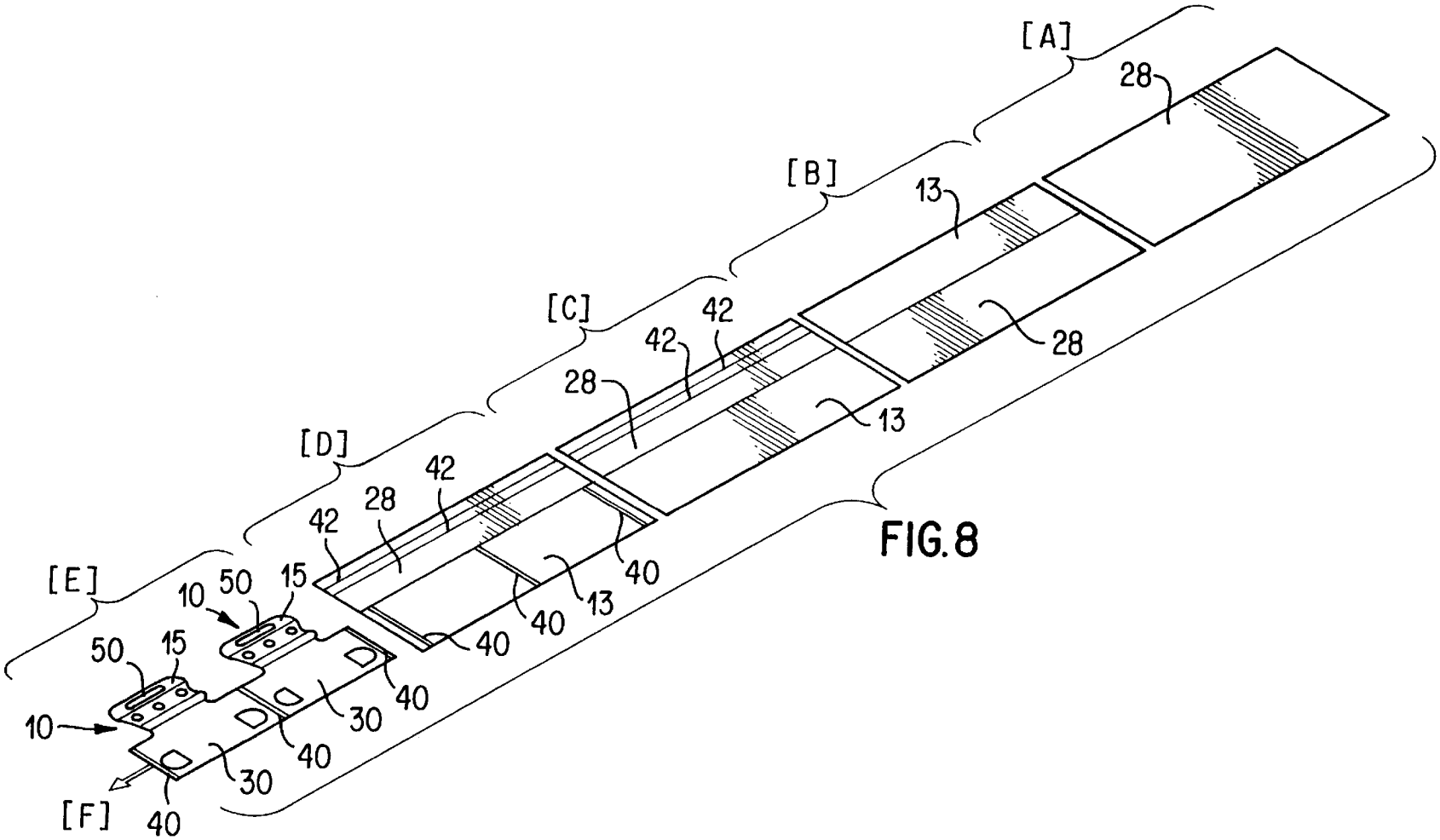
FIG. 8 is a schematic of a method for making a carrier for holding a plurality of containers according to yet another preferred embodiment of this invention.

In one preferred embodiment of this invention, shown in FIGS. 6 and 8, handle 50 is integrated within retainer sheet 15. Handle 50 preferably has a same or similar thickness as retainer sheet 15. In one preferred embodiment of this invention, shown in FIGS. 6 and 8, handle 50 is integrated between longitudinal rows of container receiving openings 20. Alternatively, package 1 may be carried using bands 55 formed between container receiving openings 20 as shown in FIGS. 3 and 5.

Film sleeve 30 is preferably integrated with retainer sheet 15 along longitudinal sides 17 of retainer sheet 15. In one preferred embodiment of this invention, film sleeve 30 is not connected along two lateral edges 18 of retainer sheet 15. Film sleeve 30 is preferably printed with, on one or both sides, UPC and proof of purchase labels, graphics, and promotional and/or other information related to contents and/or ingredients of package 1. Film sleeve 30 may additionally be at least partially transparent to effectively display nature of containers 5. Therefore, film sleeve 30 serves the dual purposes of retaining containers 5 within a tightly assembled package 1 and advertising marketable features of the containers 5 and/or package 1.

In one preferred embodiment of this invention shown in FIG. 2, film sleeve 30 is open along lower edge 33 of carrier 10. As shown in FIG. 1, lower edge 33 of carrier 10 may further include bottom 35 of film sleeve 30. Each side edge 37 of film sleeve 30 is preferably bound with seal 40. Therefore, film sleeve 30 extends from openable lower edge 33 of carrier to seals 40 on either side edge 37 of film sleeve to retainer sheet 15 at a top portion of carrier 10.

As shown in FIGS. 1 and 2, carrier 10 is preferably generally symmetrical around fold lines 25. As discussed in detail below, carrier 10 is manufactured so that retainer sheet 15 and film sleeve 30 are each preferably symmetrical around fold lines 25.

Carrier 10 is applied to a plurality of containers 5 to form package 1, shown in FIGS. 3 and 5. Containers 5 are inserted within carrier 10 which bounds containers 5 around between five and six sides of package 1. Each container receiving opening 20 preferably engages container 5, preferably around chime 7 or similar upper portion of container 5. The rigidity and elasticity of retainer sheet 15 supports container 5 within container receiving opening 20. A top portion of package 1 is therefore at least partially covered by retainer sheet 15.

As shown in FIGS. 3 and 5, film sleeve 30 is positioned around the plurality of containers 5. Preferably, film sleeve 30 is stretchingly engaged with containers 5 and the combination of container receiving openings 20 and sleeve 30 prevents skewing or lateral movement of containers 5 with respect to each other. In one preferred embodiment of this invention, shown in FIGS. 2 and 3, film sleeve 30 covers at least a portion of four horizontal sides of package 1.

Containers 5 arc positioned within package 1 so that film sleeve 30 is flat and tight with respect to containers 5 and prominent with respect to package 1. Film sleeve 30 is preferably sized to stretch when slid over a plurality of containers 5. Such a configuration of film sleeve 30 results in package 1 having a prominent display area or "billboard" for advertising, information, graphics and other marketing material.

In another preferred embodiment of this invention, shown in FIGS. 1, 4 and 5, film sleeve 30 covers at least a portion of a bottom of package 1. Film sleeve 30 preferably covers at least a portion of the bottom of package 1 when one or more containers 5 are not engaged with container receiving openings 20. For instance, carrier 10 shown in FIG. 1 requires bottom 35 because retainer sheet 15 includes only two container receiving openings 20 in carrier 10 that holds more than two containers 5. Carrier 10 shown in FIG. 5 also requires bottom 35 because, of the twelve containers 5 in package 10, the lower six containers 5' in package 1 are not supported around chime 7 by retainer sheet 15. Therefore, bottom 35 provides support for those containers 5 not supported within container receiving openings 20.

As shown in FIGS. 3–5, package 1 may additionally contain pull tab 45 and/or line of perforation 47 positioned within film sleeve 30. Using an arrangement such as shown in FIGS. 3–5, package 1 may be opened by pulling pull tab 45 across longitudinal side 17 of package 1 thereby tearing line of perforation 47 to access containers 5.

A package according to FIGS. 4 and 5 will have the novel characteristic of having an upper level of containers 5 removable from a lower level of container 5' while keeping the upper level of containers 5 integrated as a sub-package and permitting the lower level of containers 5' to be freely removable for individual consumption or storage.

According to one preferred embodiment of this invention, perforated removal strip 49 facilitates the efficient removal of the upper level of containers 5 and retainer sheet 15 from the lower level of containers 5 and sleeve 30. Perforated removal strip 49 is designed so a single pulling action of tab 45 circumferentially around package 1 will disassociate retainer sheet 15 and upper level of containers 5' from sleeve 30. Welded tabs 51 at an end panel of package 1 permit such single pulling action removal from either side of package 1. FIG. 6 shows carrier 10 according to this preferred embodiment, which is contemplated to be manufactured similar to FIG. 7, described below.

Figure 7:
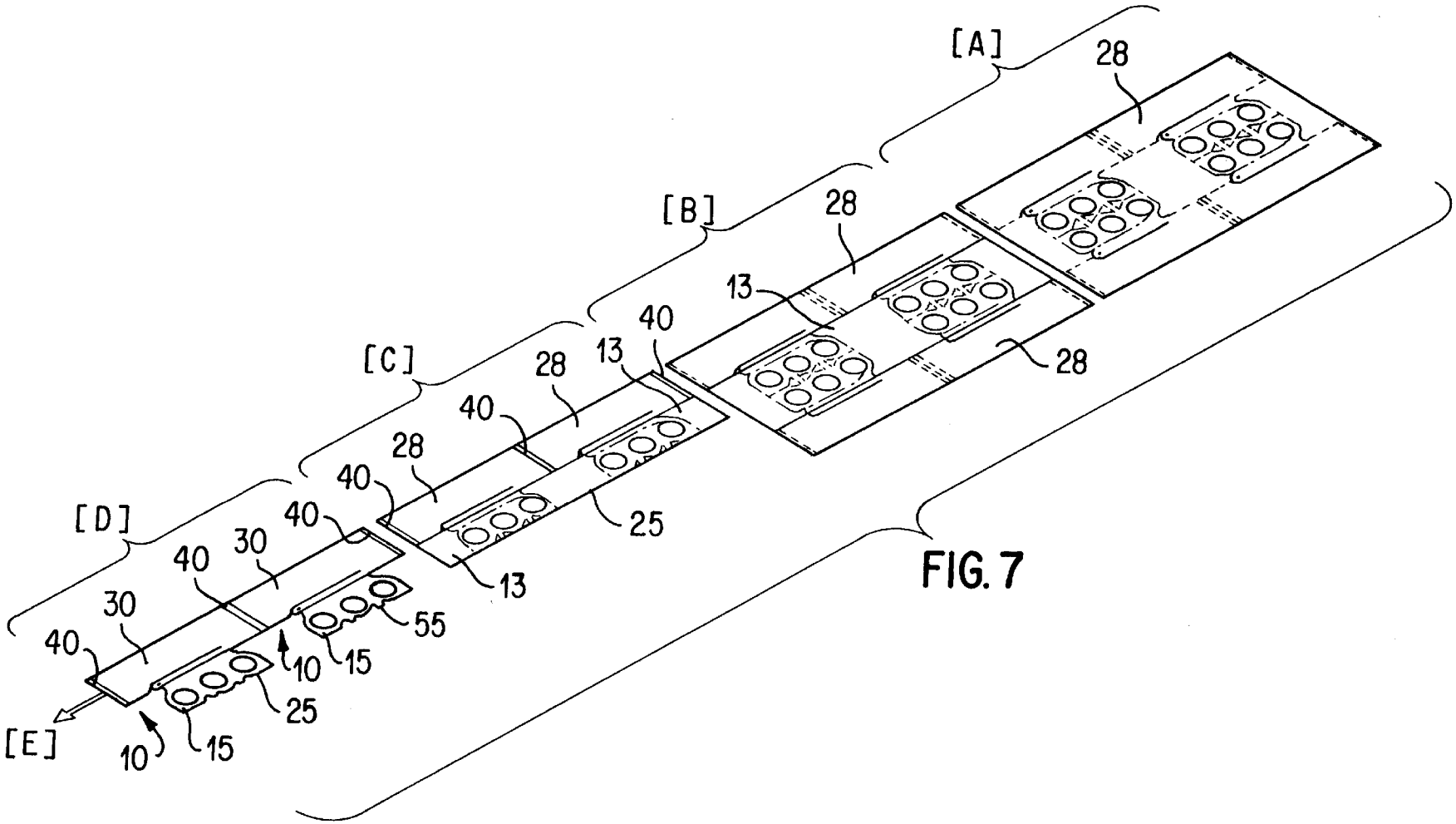
FIG. 7 is a schematic of a method for making a carrier, similar to the carriers shown in FIGS. 2 and 3, for holding a plurality of containers according to another preferred embodiment of this invention.

FIGS. 6–8 show methods for manufacturing carrier 10 according to three preferred methods of this invention. The methods shown in FIGS. 6–8 demonstrate from right to left the assembly of various components of carrier 10, each step in the method designated by a letter of the alphabet. Each step of each method of manufacture includes two carriers 10 to demonstrate a representative segment of carriers 10 that are typically formed in a generally continuous length.

FIG. 6 shows a method for manufacturing carrier 10 according to one preferred embodiment of this invention. In step [A] film substrate 28 is printed with desired graphics and other merchandising information. In step [B] retainer sheet material 13 is joined to film substrate 28 by extrusion coating, laminating, profile extrusion or glueing retainer sheet material 13 to film substrate 28. In step [C] retainer sheet material 13 and film substrate 28 are folded along fold line 25 to create a symmetrical double layer. In step [D] seams 40 are added by heat sealing or laminating the symmetrical double layer of retainer sheet material 13 and film substrate 28 together. In step [E] carrier 10 is formed by cutting, such as in a punch press, the double layer of retainer sheet material 13 and film substrate 28 to define film sleeve 30 and retainer sheet 15. Step [F] (not shown) preferably comprises accumulating the continuous strip of carriers 10 by fan folding or rolling about a core. Carriers 10 according to this invention, regardless of the method of manufacture, are not conducive to winding on reels because of the variable thickness between film sleeve 30 and retainer sheet 15.

FIG. 7 shows a method for manufacturing carrier 10 according to another preferred embodiment of this invention. In step [A] film substrate 28 is printed with desired graphics and other merchandising information. In step [B] retainer sheet material 13 is joined to film substrate 28 by extrusion coating, laminating, profile extrusion, or glueing retainer sheet material 13 to film substrate 28. In step [C] retainer sheet material 13 and film substrate 28 are folded along fold line 25 to create a symmetrical double layer and seams 40 are added by heat sealing or laminating the symmetrical double layer of retainer sheet material 13 and film substrate 28 together. In step [D] carrier 10 is formed by cutting, such as in a punch press, the double layer of retainer sheet material 13 and film substrate 28 to define film sleeve 30 and retainer sheet 15. Step [E] (not shown) preferably comprises accumulating the continuous strip of carriers 10 by fan folding or rolling about a core.

FIG. 8 shows a method for manufacturing carrier 10 according to yet another preferred embodiment of this invention. In step [A] film substrate 28 is printed with desired graphics and other merchandising information. In step [B] retainer sheet material 13 is joined to film substrate 28 by extrusion coating or laminating retainer sheet material 13 to film substrate 28. In step [C] two identical sheets of retainer sheet material 13 and film substrate 28 are laminated together along lamination lines 42. Step [C] requires careful registration to align two identical portions of joined retainer sheet material 13 and film substrate 28 prior to lamination. In step [D] seams 40 are added by heat sealing or laminating the two identical sheets of retainer sheet material 13 and film substrate 28 together. In step [E] carrier 10 is formed by cutting, such as in a punch press, the two sheets of retainer sheet material 13 and film substrate 28 to define film sleeve 30 and retainer sheet 15. Step [F] (not shown) preferably comprises accumulating the continuous strip of carriers 10 by fan folding or rolling about a core.

FIGS. 9–11 show a single-piece carrier for carrying a plurality of containers 5 according to another preferred embodiment of this invention. FIG. 9 shows a top view of half of carrier 110. Carrier 110 is preferably symmetrical about handle 150 and formed using a method similar to one of the methods discussed above. FIG. 10 shows a complete view of retainer sheet 115 according to one preferred embodiment of this invention.

Retainer sheet 115 is preferably constructed from low density polyethylene similar to retainer sheet 15 described above. However, according to this preferred embodiment, carrier sleeve 130 is preferably formed of a material having a different thickness from retainer sheet 115. As shown in FIGS. 9 and 11 carrier sleeve 130 is integrally formed with respect to retainer sheet 115.

As shown in FIG. 10, retainer sheet 115 is formed with a plurality of container receiving openings 120 that are preferably positioned in two longitudinal rows along each longitudinal edge 117 of retainer sheet 115. As shown in FIGS. 9–11, retainer sheet 115 may be formed with two longitudinal rows of four container receiving openings 120 or any alternative configuration of container receiving openings 120.

Handle 150 is preferably integrally formed within retainer sheet 115 between the two longitudinal rows of container receiving openings 120. Handle 150 is preferably generally flat with respect to retainer sheet 115.

Partial container receiving openings 125 are formed on each side of handle 150, generally along each lateral edge 118 of retainer sheet 115. Partial container receiving openings 125 are formed to engage container 5 at least along each lateral edge 118 of retainer sheet 115 to prevent the middle row of containers 5 from skewing with respect to one another in assembled package 100.

As discussed above, carrier sleeve 130 is integrated with retainer sheet 115, preferably along each longitudinal edge 117 of retainer sheet 115. Carrier sleeve 130 is preferably not integrated with respect to retainer sheet 115 along each lateral edge 118 of retainer sheet 115. Carrier sleeve 130 further comprises bottom panels 160 and a plurality of side panels 170. Bottom panels 160 are preferably attached with respect to each other with seam 40 or other weld to form a solid bottom.

According to one preferred embodiment of this invention, pull tab 180 is positioned in carrier sleeve 130 adjacent at least one of the partial container receiving openings 125. Pull tab 180 is preferably connected with respect to tear strip 190 between pull tab 180 and a middle portion of carrier sleeve 130. Tear strip 190 is preferably formed with a line of perforations or other weakening feature formed within carrier sleeve 130.

As discussed in the alternative embodiments of this invention, one or more seams 40 are preferably formed within side panels 170. Seams 40 are primarily used to simplify construction of carrier 110, however according to one preferred embodiment of this invention, tear strips 190 are formed on either side of seam 40 to facilitate removal of containers 5 from package 100. According to one preferred embodiment of this invention, seam interrupt 142 is positioned along seam 40, preferably at an approximate midpoint of seam 40. Seam interrupt 142 is positioned along seam 40 to prevent tear strip 190 from tearing completely into a lower level of containers 5' within package 100.

Package 100, shown in FIG. 11, includes a plurality of containers, such as a typical multipackage size of twenty-four cans as shown in FIG. 11. Containers 5 are preferably arranged in an upper level and a lower level within carrier 110. Each container receiving opening 120 preferably engages a container 5 in the upper level of the plurality of containers 5. Each partial container receiving opening 125 preferably engages container 5 in the upper level of containers 5 around at least a portion of chime 7 of container 5. The lower level of containers 5' within carrier 110 are preferably seated on bottom panel 160 within carrier sleeve 130.

Handle 150 is positioned over the center longitudinal row of containers 5 and between the two longitudinal rows of containers along the longitudinal edges 117 of retainer sheet 115. Handle 150 is of suitable size, shape and thickness to support entire weight of package 100.

Carrier sleeve 130 is positioned around the plurality of containers 5, preferably so that each of the six sides of package 100 are shrouded with at least a portion of carrier sleeve 130 or retainer sheet 115. Carrier sleeve 130 may be printed with graphics and other promotional and/or merchandising information.

Tear strip 190 and/or pull tab 180 are preferably positioned in carrier sleeve 130 for disassociating one or more containers 5 in the upper level of the plurality of containers 5 from package 100. Tear strip 190 is severed by user and preferably extends downward through carrier sleeve 130 to expose the upper level of containers 5 for removal from package 100. Preferably, the lower level of containers 5' is not released by separating tear strip 190. As shown in FIG. 11, tear strip 190 extends in a vertical direction until reaching seam interrupt 142 and then continues in a horizontal direction thereby preventing tear strip 190 from extending into the lower level of containers 5'. This is because, according to one preferred embodiment of this invention, containers 5 may be removed from the upper level of package 100 and yet package 100 will still function to unitize the lower level of containers 5'.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A single-piece carrier for carrying a plurality of containers, the carrier comprising:

a retainer sheet having a plurality of container receiving openings for stretchingly engaging the plurality of containers positioned in at least three longitudinal rows, an outer longitudinal row of container receiving openings formed along each longitudinal edge of the retainer sheet;

a handle formed within the retainer sheet between the outer longitudinal rows of container receiving openings and over a top portion of a center longitudinal row of containers;

a partial container receiving opening formed on each side of the handle along each lateral edge of the retainer sheet, the partial container receiving opening for engaging a container only along a lateral edge of the retainer sheet;

a stretchable carrier sleeve integrated with each longitudinal edge of the retainer sheet to form a single-piece carrier.

2. The carrier of claim 1 wherein the carrier sleeve further comprises a bottom panel.

3. The carrier of claim 1 wherein the carrier is symmetrically formed about the handle.

4. The carrier of claim 1 further comprising a pull tab positioned in the carrier sleeve adjacent at least one of the partial container receiving openings.

5. The carrier of claim 4 further comprising a tear strip between the pull tab and a middle portion of the carrier sleeve.

6. The carrier of claim 1 wherein the carrier sleeve forms a plurality of side panels.

7. The carrier of claim 1 wherein a seam is formed within at least one side panel.

8. The carrier of claim 7 further comprising a tear strip formed on each side of the seam.

9. The corner of claim 1 wherein the handle and the retainer sheet are coplanar.

10. A package of a plurality of containers, the package comprising:

a retainer sheet, the retainer sheet having a plurality of container receiving openings arranged in two longitudinal rows along each longitudinal edge of the retainer sheet;

a plurality of containers arranged in an upper level and a lower level, each container receiving opening of the plurality of container receiving openings engaged with a container in the upper level of the plurality of containers;

a handle positioned over a top of a center longitudinal row of containers and between the two longitudinal rows of container receiving openings;

a partial container receiving opening formed at each lateral edge of the handle, the partial container receiving opening partially engaging a container along a portion of a chime of the container; and a carrier sleeve positioned around the plurality of containers, the carrier sleeve integrated with the retainer sheet to form a single-piece carrier.

11. The package of claim 10 wherein the carrier sleeve surrounds each side and a bottom of the package of the plurality of containers.

12. The package of claim 10 further comprising a partial container receiving opening positioned on each side of the handle along each lateral edge of the retainer sheet, the partial container receiving opening partially engaging a container in the upper level of the plurality of containers.

13. The package of claim 10 further comprising a tear strip positioned in the carrier sleeve for disassociating one or more containers in the upper level of the plurality of containers from the package.

14. The package of claim 13 wherein the tear strip extends downward through the carrier sleeve and up to the lower level of the plurality of containers.

15. A package of a plurality of containers, the package comprising:

a retainer sheet, the retainer sheet having a plurality of container receiving openings arranged in outer longitudinal rows along each longitudinal edge of the retainer sheet;

a plurality of containers arranged in an upper level, each container receiving opening of the plurality of container receiving openings engaged with a container of the plurality of containers in the upper level;

a handle positioned in the retainer sheet between the outer longitudinal rows of container receiving openings and over a top of a middle row of containers;

a partial container receiving opening positioned on each side of the handle along each lateral edge of the retainer sheet, each partial container receiving opening partially engaging a container along a portion of a chime of the container;

a plurality of containers arranged in a lower level, the upper level of containers positioned on top of the lower level of containers; and a carrier sleeve positioned around the upper level and the lower level of the plurality of containers, the carrier sleeve integrated with the retainer sheet to form a single-piece carrier.

16. The package of claim 15 wherein the handle is formed in a generally flat position with respect to a top of the package.

17. The package of claim 15 wherein a perforated tear strip is positioned within the carrier sleeve for disassociating one or more containers from the upper level of containers from the package.

18. The package of claim 15 further comprising a pull tab formed in the carrier sleeve adjacent the lateral edge of the retainer sheet.

* * * * *